US005697118A

United States Patent [19]

Lizakowski

[11] Patent Number: 5,697,118

[45] Date of Patent: Dec. 16, 1997

[54] SNAKE FEEDER

[76] Inventor: Allen J. Lizakowski, 4414 Black Walnut Woods, San Antonio, Tex. 78249

[21] Appl. No.: 688,437

[22] Filed: Jul. 30, 1996

[51] Int. Cl.[6] ..... B08B 9/02

[52] U.S. Cl. ..... 15/104.33

[58] Field of Search ..... 15/104.33

[56] References Cited

U.S. PATENT DOCUMENTS 5,500,974 3/1996 Wu ..... 15/104.33

FOREIGN PATENT DOCUMENTS 16408 10/1956 Germany ..... 15/104.33

715862 9/1954 United Kingdom ..... 15/104.33

*Primary Examiner*—Mark Spisich

[57] ABSTRACT

An assembly capable of providing rotary motion to a conventional spiralled sewer cleanout wire by utilizing conventional power driving tools or a hand crank that may be readily attached to the assembly.

1 Claim, 1 Drawing Sheet

SNAKE FEEDER

BACKGROUND OF THE INVENTION

This invention pertains in general to sewer cleanout devices, and more particularly, to a device that will provide enhanced rotary capabilities to a conventional spiralled sewer cleanout wire, commonly known as a snake.

Heretofore, the mechanisms available to rotate and propel a sewer cleanout snake consisted primarily of two different types of apparatus. The first category includes various types of self propelled, motor driven apparatus that simultaneously rotate the entire coiled length of the snake. These self contained machines are bulky, cumberesome, and not cost effective to purchase for the average person. Smaller, self contained plastic versions of these machines are limited to a short length of cleanout wire and do not develop the necessary torque to remove large clogs in blocked sewers. The alternative is a piece of pre-bent conduit through which the uncoiled snake is inserted, which, when turned by hand, is awkward and inefficient.

Consequently, it is desirable to provide an assembly which would provide the capabilities of rotating an uncoiled snake, be mechanically driven, portable, and be cost effective for the average person to possess.

Further objects and advantages of the invention will be set forth in the following specification and will be obvious therefrom without being specifically referred to, the same being realized and obtained as will be pointed out in the claims hereof.

BRIEF DESCRIPTION OF THE DRAWINGS

For a more complete understanding of the nature and object of the invention as briefly summarized above, reference may be had to the appended drawings which form a part of this specification in which.

DESCRIPTION OF THE PREFERRED EMBODIMENTS

Figure 1:
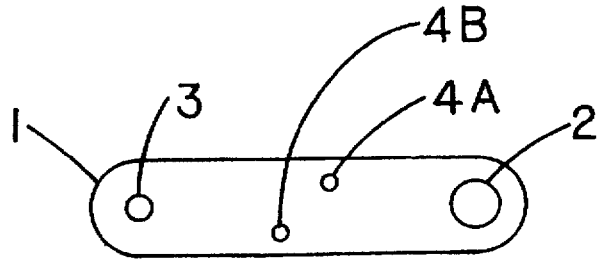
FIG. 1 is a sectional view of one of the two main mounting plates that support the complete assembly.

Referring now to the drawings and first to FIG. 1, a mounting plate 1 is a fiat piece of a rigid and durable material such as steel or a polymer material and is provided with orifices to accommodate various attachments. Orifice 2 provides the support for a driven cylinder 5, FIG. 2. Orifice 3 provides the support for a driving shaft 13, FIG. 2. Orifices 4A and 4B provide for the attachment of a handle 9, FIG. 2.

Figure 2:
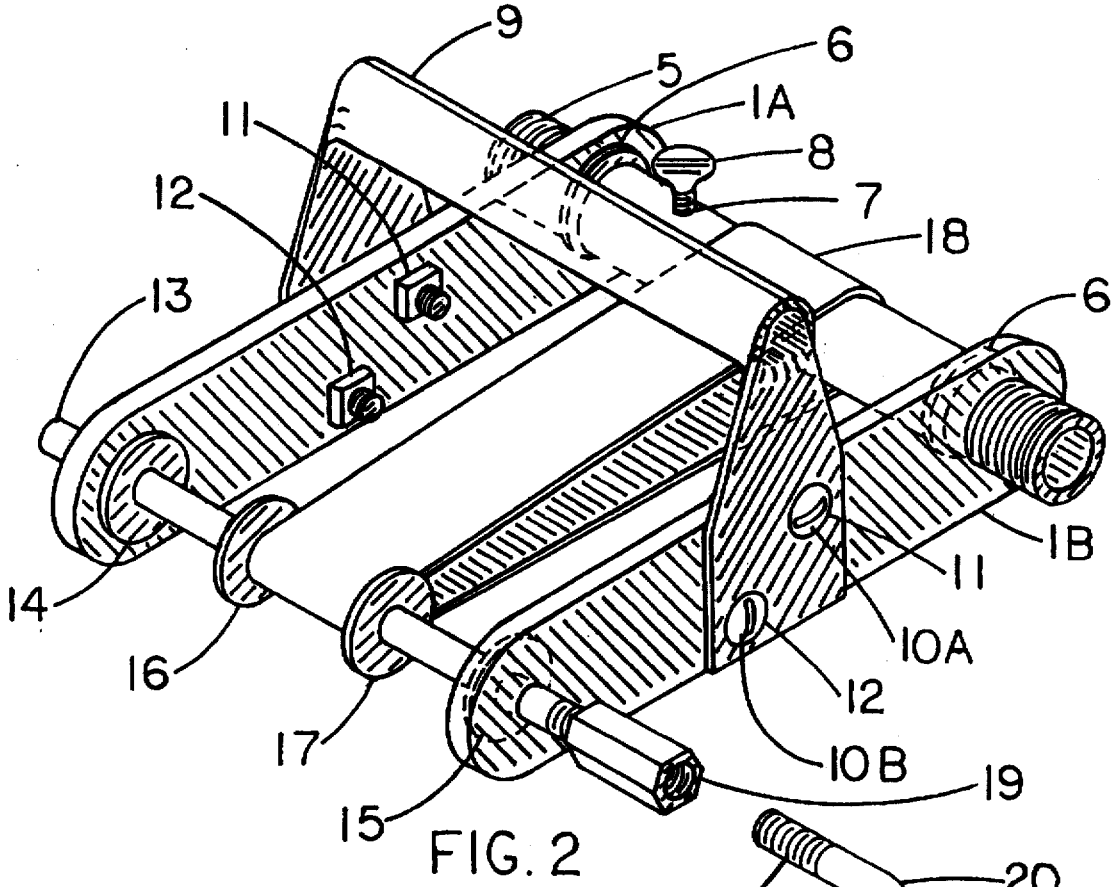
FIG. 2 is an isometric view of the assembled snake feeder.

As shown in FIG. 2, the present invention is illustrated isometrically to display complete assembly components. The two mounting plates 1A and 1B are mounted parallel to each other and are secured in this position with handle 9 by inserting fasteners 11 and 12 through orifices 10A and 10B in the handle 9, thence through orifices in the mounting plates previously designated as 4A and 4B of plate 1, FIG. 1, to complete the assembly. Threaded shaft 13 is then inserted through orifices of mounting plates 1A and 1B, previously designated as orifice 3, FIG. 1. The threaded shaft 13 is prevented from lateral movement in the assembly by attachment of washers 14 and 15 to the threaded shaft 13, adjacent to and inside mounting plates 1A and 1B. Washers 16 and 17 are also attached to threaded shaft 13, adjacent and exterior to drive belt 18, to prevent lateral movement of drive belt 18 when the mechanism is in motion. Coupling nut 19 is attached to the end of threaded shaft 13 to support attachment of various elements necessary to provide rotary motion to the snake feeder.

A hollow cylinder shown as threaded pipe 5 is supported in the mounting plates 1A and 1B through orifice 2, FIG. 1, and is prevented from lateral movement in the assembly by attachment of the washers 6 to threaded pipe 5, adjacent to mounting places 1A and 1B. Thumb screw 8 is inserted into threaded pipe 5 through a threaded orifice 7. Thumb screw 8 is utilized to secure any driven object placed inside threaded pipe 5 during rotary motion. Drive belt 18 is looped around threaded shaft 5 to provide the rotary motion when threaded pipe 13 is turned. Although not shown for purposes of clarity, threaded pipe 5 may be threaded throughout the entire length of the pipe to provide additional traction for drive belt 18 during the periods when the assembly is exposed to fluids encountered during operation, such as water.

Figure 3:
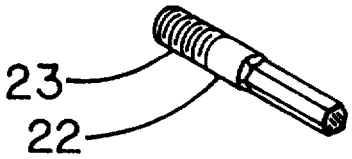
FIG. 3 is an isometric view of an adapter that is attached to the snake feeder to permit separate mechanized rotational capabilities.

Referring now to FIG. 3, a stud 22 is threaded on one end 23, to permit attachment of the stud to the snake feeder at and in coupling nut 19 FIG. 1. Stud 22 may then be inserted into and driven by a mechanical rotary device such as a common household drill to provide rotary motion to the snake feeder.

Figure 4:
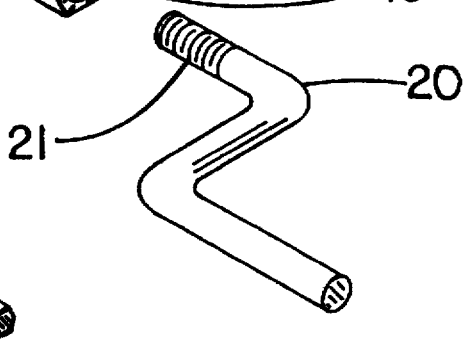
FIG. 4 is an isometric view of an adapter that is attached to the snake feeder to permit manual rotation.

Referring now to FIG. 4, the hand held crank 20 is threaded on end 21 to permit attachment of the hand held crank 20 to the snake feeder at and into coupling nut 19 FIG. 1. Hand held crank 20 may be utilized to manually provide rotary motion to the snake feeder when the availability of a mechanized rotary device is unavailable.

Although the preferred embodiment has been described in detail, it should be understood that various changes, substitutions and alterations may be made therein without departing from the spirit and scope of the invention as defined by the appended claims.

I claim as my invention:

1. An assembly providing rotary motion to a coiled sewer cleanout wire comprising;

a pair of parallel flat mounting plates each provided with a plurality of orifices and including a far end and a near end, and a handle attached perpendicularly to said flat mounting plates securing said flat mounting plates an equal distance apart, and a hollow driven cylinder inserted perpendicularly into far end orifices of said pair of parallel mounting plates and secured with stops which allow said hollow driven cylinder to be rotated freely in and without lateral motion between said flat mounting plates, and a set screw inserted perpendicularly into said hollow driven cylinder thereby permitting a driven device inserted into said hollow driven cylinder to be secured and travel with the rotational path of said hollow cylinder, and a driving shaft inserted into and passing through the near end of said parallel mounting plates, and secured with stops which allow said driving shaft to rotate freely between said mounting plates without lateral movement, and a driving belt placed around said driving shaft and said hollow driven cylinder, and a stop attached to said driving shaft an opposite sides of said driving belt to prevent lateral travel of said driving belt along the surface of said driving shaft during rotary motion, and a coupling nut affixed to one end of said driving shaft, exterior to the surfaces of said flat mounting plates to permit various threaded devices to be secured into said coupling nut that will provide rotary motion to said driving shaft and, by means of said driving belt, said hollow driven cylinder and said driven device located therein.

* * * * *